US006394022B1

(12) United States Patent
Johnston et al.

(10) Patent No.: US 6,394,022 B1
(45) Date of Patent: May 28, 2002

(54) TRIBOLUMINESCENT TAMPER-INDICATING DEVICE

(75) Inventors: Roger G. Johnston, Los Alamos; Anthony R. E. Garcia, Espanola, both of NM (US)

(73) Assignee: The Regents of the University of California, Los Alamos, CA (US)

( * ) Notice: Subject to any disclaimer, the term of this patent is extended or adjusted under 35 U.S.C. 154(b) by 80 days.

(21) Appl. No.: 09/648,068

(22) Filed: Aug. 25, 2000

(51) Int. Cl.[7] ..... B65D 51/18
(52) U.S. Cl. ..... 116/206; 116/200; 215/230
(58) Field of Search ..... 116/200, 206, 116/207; 215/230; 206/459.1, 459.5; 436/172; 422/52; 346/107.1

(56) References Cited

U.S. PATENT DOCUMENTS

| | | | | | |
|---|---|---|---|---|---|
| 2,630,534 | A | * | 3/1953 | Heinecke et al. | 430/139 |
| 4,095,872 | A | * | 6/1978 | Stieff et al. | 385/115 |
| 4,505,399 | A | * | 3/1985 | Weiner | 215/203 |
| 4,825,801 | A | * | 5/1989 | Weber | 116/201 |
| 4,927,036 | A | * | 5/1990 | Diehl Pojedinec | 215/203 |
| 5,018,632 | A | * | 5/1991 | Schmidt | 215/230 |
| 5,617,812 | A | * | 4/1997 | Balderson et al. | 116/206 |
| 5,905,260 | A | | 5/1999 | Sage et al. | 250/306 |

OTHER PUBLICATIONS

R. G. Johnston et al., LA–UR–98–4874, "Tamper Detection for Waste Managers," Proceedings of Waste Management '99, (Feb. 28–Mar. 4, 1999, Tucson, AZ) p. 12/25–1 to 12/25–11.

R. G. Johnston, LA–UR–96–3938, "The Real Deal on Seals Improving Tamper Detection", Security Management, vol. 41 (1997) p. 93–100.

* cited by examiner

*Primary Examiner*—Diego Gutierrez
*Assistant Examiner*—R. Alexander Smith
(74) *Attorney, Agent, or Firm*—Samuel L. Borkowsky

(57) ABSTRACT

A tamper-indicating device is described. The device has a transparent or translucent cylindrical body that includes triboluminescent material, and an outer opaque layer that prevents ambient light from entering. A chamber in the body holds an undeveloped piece of photographic film bearing an image. The device is assembled from two body members. One of the body members includes a recess for storing film and an optical assembly that can be adjusted to prevent light from passing through the assembly and exposing the film. To use the device with a hasp, the body members are positioned on opposite sides of a hasp, inserted through the hasp, and attached. The optical assembly is then manipulated to allow any light generated from the triboluminescent materials during a tampering activity that damages the device to reach the film and destroy the image on the film.

23 Claims, 8 Drawing Sheets

TRIBOLUMINESCENT TAMPER-INDICATING DEVICE

This invention was made with government support under Contract No. W-7405-ENG-36 awarded by the U.S. Department of Energy to The Regents of the University of California. The U.S. government has certain rights in the invention.

FIELD OF THE INVENTION

The present invention relates generally to tamper-indicating devices and, more particularly, to a triboluminescent tamper-indicating device that can be used with a hasp to provide a container with a seal.

BACKGROUND OF THE INVENTION

Tamper-indicating devices are widely used to detect tampering or unauthorized entry into a container, building, railcar, etc. These devices include frangible films, pressure sensitive adhesive tapes, crimped cables, electronic systems that continuously monitor changes in electric cables or fiber optic bundles, and other devices that are intended to display irreversible damage or changes when manipulated. They are used to detect theft of items during transportation and warehousing. They are used in retail and corporate security applications such as recordkeeping and inventory control. They are used in law enforcement and national security applications such as counterterrorism, counterintelligence, and protection of specimens for drug testing. They are used in a variety of defense applications such as managing hazardous and nuclear materials and weapons. They are used in the health industry to protect instrument calibrations, medical products, blood bank supplies, and pharmaceuticals. They are used to protect records in the banking industry. They are used to detect and prevent ballot box fraud during elections. In short, these are extremely important devices that are designed with the intention of providing unambiguous and non-erasable evidence of tampering and unauthorized entry.

A tamper-indicating device has been defeated when it is "opened" and "closed", "activated" and "deactivated", etc. while leaving no detectable evidence. Although devices may be damaged during a tampering activity, they can still be defeated if the damage is repaired or if the damaged part, parts, or entire device is replaced with counterfeit(s) in order to confuse the altered device with the original. Although traditional tamper-indicating devices attempt to provide physical, electronic, or some other type of evidence of tampering, this evidence can often be erased easily and quickly. Intrusion alarms, for example, that provides a record of tampering by sending an alarm signal in real-time to a security headquarters, are often easily disabled. Similarly, many tamper-indicating devices can be easily counterfeited. For further description of tamper-indicating devices, see: R. G. Johnston et al. in "Tamper Detection for Waste Managers," Proceedings of Waste Management '99, (Feb. 28–Mar. 4, 1999, Tucson, Ariz.) p. 12/25-1 to 12/25-11; and R. G. Johnston in "The Real Deal on Seals," Security Management, vol. 41 (1997) p. 93–100.

Clearly, effective tamper-indicating devices are highly desirable. Therefore, an object of the present invention is a tamper-indicating device that provides a permanent record of tamper-indicating activity.

Another object of the present invention is a tamper-indicating device that can be used with a hasp to provide a container, building, railcar, etc. with a seal.

Still another object of the present invention is a tamper-indicating device that is harder to defeat than traditional tamper-indicating devices.

Yet another object of the present invention is a tamper-indicating device that does not require electrical power or batteries.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention as embodied and broadly described herein, the invention includes a tamper-indicating device having a transparent or translucent body that includes triboluminescent material. A piece of photographic film bearing an undeveloped image is attached inside a chamber in the device. An opaque layer covering the body prevents ambient light from exposing the film but does not prevent light generated by the triboluminescent material from entering the chamber and exposing the film.

The invention may also include an optical assembly for preventing exposure of the film before the device is attached to a hasp, and after it is removed from a hasp.

The optical assembly may include two coaxial polarizers, one fixed and the other rotatable.

The device may also include a ring magnet for rotating the rotatable polarizer.

BRIEF DESCRIPTION OF THE DRAWINGS

The accompanying drawings, which are incorporated in and form a part of the specification, illustrate embodiments of the present invention and, together with the description, serve to explain the principles of the invention.

In the Figures.

DETAILED DESCRIPTION OF THE INVENTION

Briefly, the invention includes a triboluminescent device that can be installed through a hasp to provide a container, truck door, railcar, etc. with a seal in a manner similar to that in which traditional tamper-indicating devices or locks are installed on hasps. The present invention provides a permanent record of tampering activity. Reference will now be made to the present preferred embodiments of the invention, examples of which are illustrated in the accompanying drawings. Similar or identical structure is identified using identical callouts.

Figure 2:
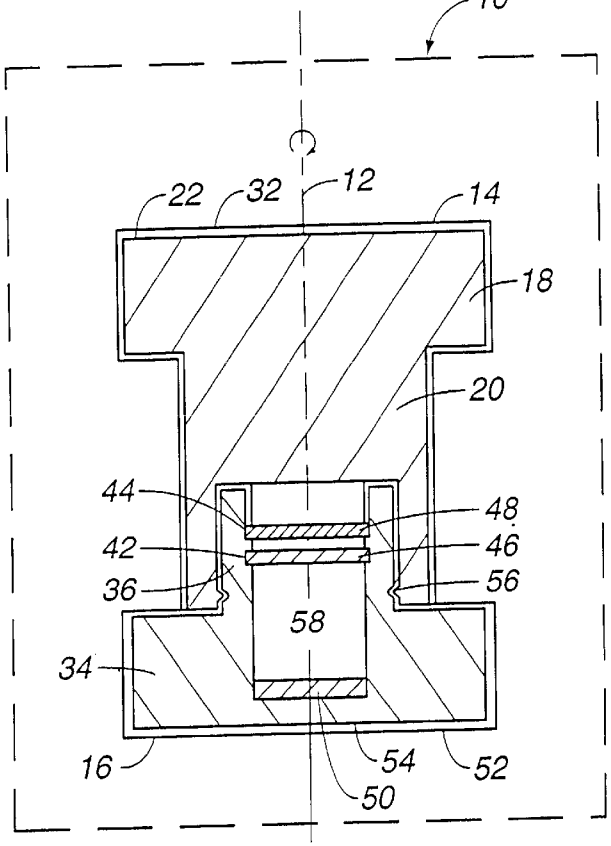
FIG. 2 shows a cross-sectional side view of the assembled embodiment of FIG. 1.
Figure 1:
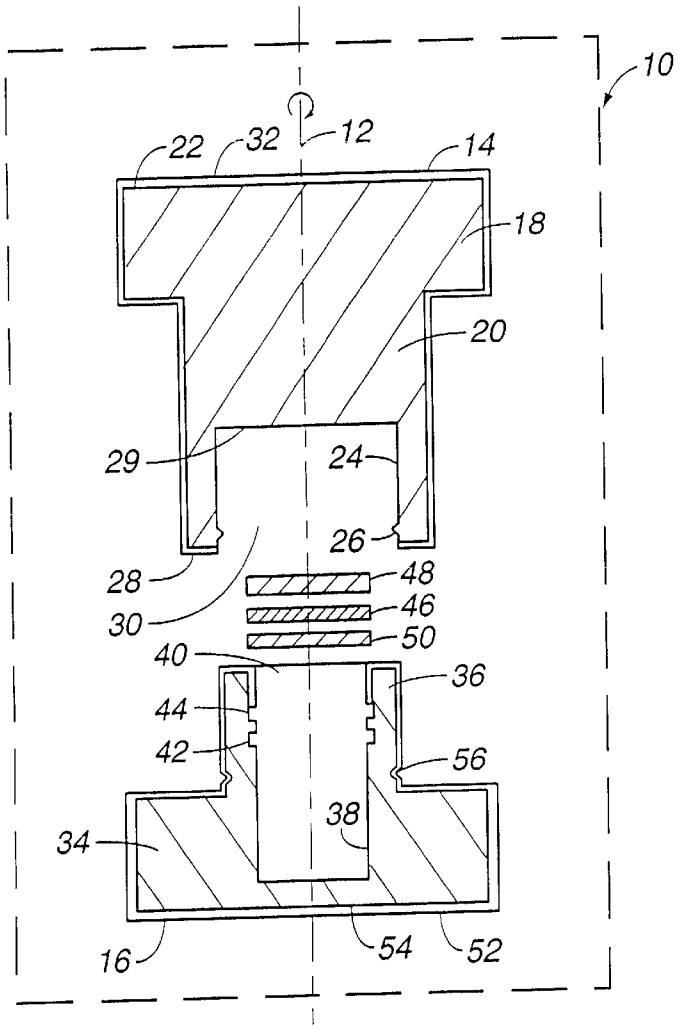
FIG. 1 shows an exploded, cross-sectional side view of a first embodiment of the present invention.

A partially exploded cross-sectional side view of an embodiment of the present invention is shown in FIG. 1, and an assembled side view is shown in FIG. 2. FIGS. 1 and 2 show cylindrical tamper-indicating device 10. Device 10 has a longitudinal axis 12, and includes first body member 14 and second body member 16. First body member 14 has a wide end portion 18 and a narrow end portion 20. Portions 18 and 20 are transparent or translucent and include triboluminescent material. First body member 14 includes an outer surface 22, and an inner cylindrical surface 24 having an inner annular surface protrusion 26 near end 28. Cylindrical surface 24 and inner surface 29 define recess 30 within body member 14. Opaque layer 32 covers body outer surface 22, but does not cover cylindrical surface 24 or inner surface 29.

Second member 16 includes wide end portion 34 and a narrow end portion 36. Portions 34 and 36 are transparent or translucent and include triboluminescent material. Inner surface 38 of second member 16 defines cylindrical recess 40. First annular groove 42 and second annular groove 44 along inner surface 38 are configured for receiving stationary first polarizer 46 and rotatable second polarizer 48, respectively. During assembly, photographic film 50 bearing an undeveloped image is placed within recess 40 and attached to inner surface 38. Then, as shown in FIG. 2, first polarizer 46 is inserted into first annular groove 42 and second polarizer 48 is inserted into second annular groove 44 such that they are in a crossed configuration, which must be determined prior to insertion. Chamber 58, shown in FIG. 2, is created after inserting polarizer 46 into groove 42. Opaque layer 52 covers outer body surface 54 completely, and also covers the portion of inner surface 38 that extends outward from second annular groove 44. Narrow end portion 36 also includes circumferential groove 56. As FIG. 2 shows, recess 30 of first member 14 and narrow end portion 36 of second member 16 are configured such that when narrow end portion 36 is completely inserted into recess 30, annular protrusion 26 of first member 14 engages circumferential groove 56 of second member 16. Upon engagement, first member 14 and second member 16 are irreversibly attached, and body member 14 cannot be separated from body member 16 without damaging device 10. Also, opaque layers 32 and 52 completely surround device 10 to prevent ambient light from exposing film 50. Rotatable polarizer 48 may include attached or embedded magnetic materials, such as iron, that can interact with an exterior magnet. After polarizer 48 is installed, it can be rotated in a non-contact fashion by moving an exterior magnet around axis 12 near device 10. During use, polarizer 48 is rotated by a known, but secret, amount to "uncross" the polarizers. Although the opaque layer still blocks ambient light from entering the device, any attempt to disengage body member 14 from body member 16 that generates friction and/or results in damage to device 10 will generate triboluminescent light that damages or destroys the undeveloped image on the film.

Device 10 must be assembled, at least in part, in a darkroom, black bag, etc. in order to prevent exposure of film 50 to ambient light. In practice, identical images are first recorded on at least two pieces of a fast, sensitive photographic film. Film 50 is placed into recess 40 of second member 16 with the emulsion side of the film in the direction of groove 44. The other piece or pieces are stored in a separate location. Film 50 is held in place with an adhesive such as glue, resin, etc. First polarizer 46 is then inserted into groove 42 and held in place, preferably with an adhesive. Second polarizer 48 is inserted into second groove 44 in such a way that polarizer 46 is in a crossed orientation relative to polarizer 48. Polarizers 44 and 46 could also be attached to mounts that fit within the grooves. Now, ambient light cannot enter chamber 58, shown in FIG. 2, in any way and second member 16 can be taken out of the dark. Device 10 is now ready for use.

Figure 3:
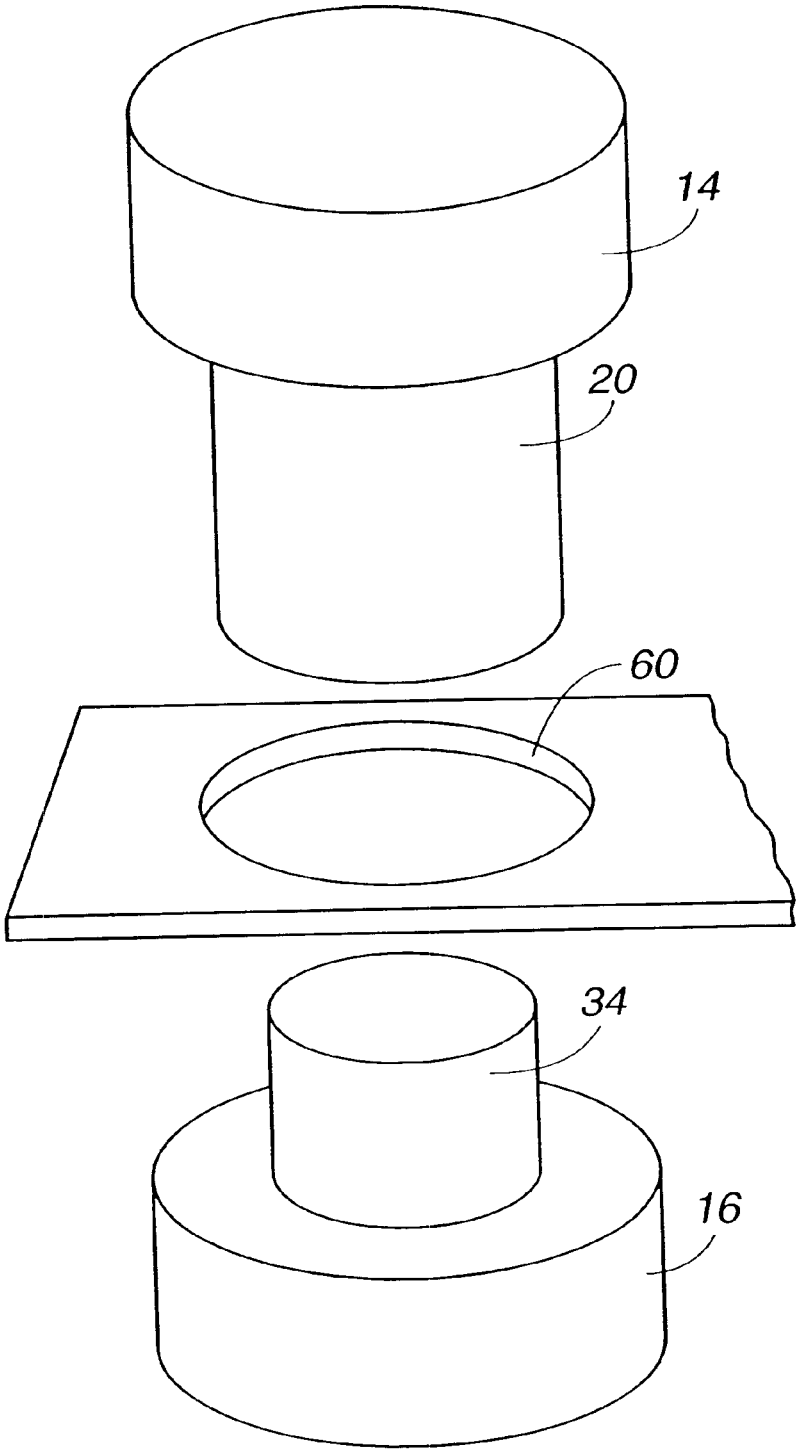
FIG. 3 shows a perspective view of the invention in position for attachment through a hasp.

FIG. 3 shows a perspective view of device 10 in position before it is installed through a hasp such as one attached to a container door. First member 14 is positioned on one side of hasp 60 and second member 16 is positioned on the other side. The narrow end portions 20 and 34 of body members 14 and 16, respectively, are inserted through the hasp. As shown in FIG. 2, end portion 34 of body member 16 slides into recess 28 of first member 14 until protrusion 26 of first member 14 engages circumferential groove 56 of second member 16. An external magnet, not shown, is brought near device 10 and rotated around longitudinal axis 12, forcing second polarizer 48 also to rotate. Prior to assembly, the relationship between a given amount of external magnet rotation with the corresponding amount of polarizer rotation is quantified, which is important because polarizer 48 will be returned to its original position at a later time. After attachment, the container is sealed. If a portion of opaque layer 32 is removed, or if device 10 is cut, sawed, drilled, or otherwise mechanically attacked or penetrated, both ambient light and triboluminescent light expose the film.

Device 10 can be checked at a later time for evidence of tampering by using the external magnet to restore the original crossed configuration between the polarizers and then removing wide end portion 18 of first member 14 without disturbing the restored polarizer configuration or damaging second member 16. Second member 16, with a portion of first member 14 still attached, is removed and taken into a darkroom, black bag, etc. Polarizers 46 and 48 are removed and film 50 is recovered. Film 50, and the other piece of stored film bearing the identical undeveloped image as film 50, are developed, and if the images are substantially the same and film 50 is not fogged, then device 10 has not been tampered with.

Figure 4:
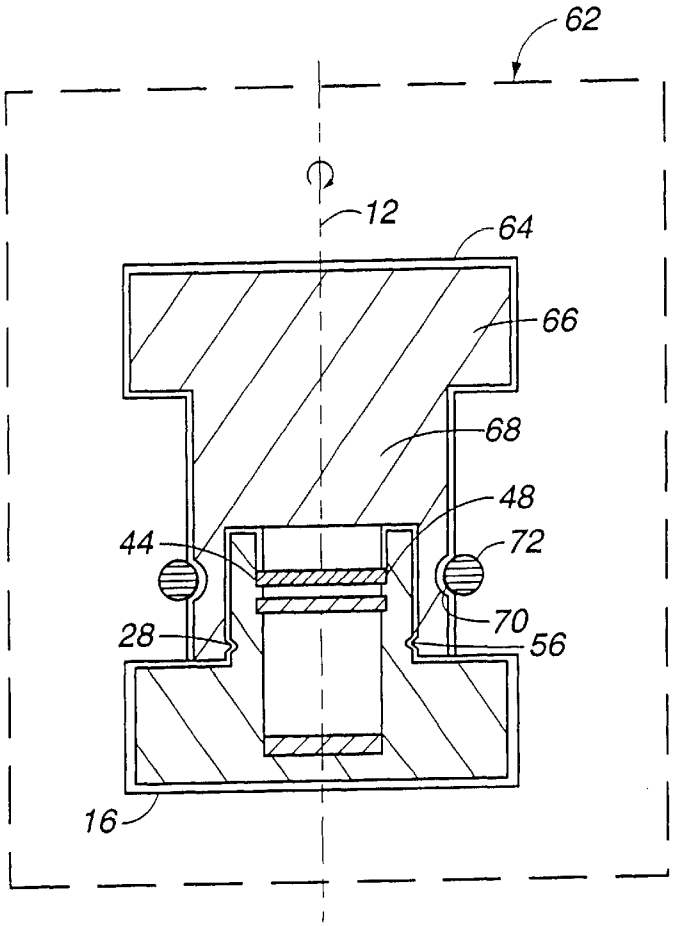
FIG. 4 shows a cross-sectional side view of a second embodiment of the invention.

FIG. 4 shows a cross-sectional side view of a second embodiment of the invention. Device 62 includes first body member 64 and second body member 16. First body member 64 has a wide portion 66 and a narrow portion 68, and is similar to first body member 14 of device 10, as can be seen by comparing FIG. 4 with FIG. 2. Unlike device 10, device 62 includes circumferential groove 70 in narrow portion 68 and ring magnet 72 that fits snugly in the groove. The groove position is chosen such that when body member 64 is attached to body member 16, rotation of ring magnet 72 through a known angle or rotation forces polarizer 48 to also rotate. When ring magnet 72 is returned to its original position, polarizer 48 is restored to its original position. Device 62 is used substantially the same way as device 10, but the crossing and uncrossing of polarizers is more easily accomplished using device 62. Ring magnet 72 can include fiduciary surface markings similar to those on a standard combination lock to aid in restoring the rotatable polarizer 48 to its original position.

Figure 5:
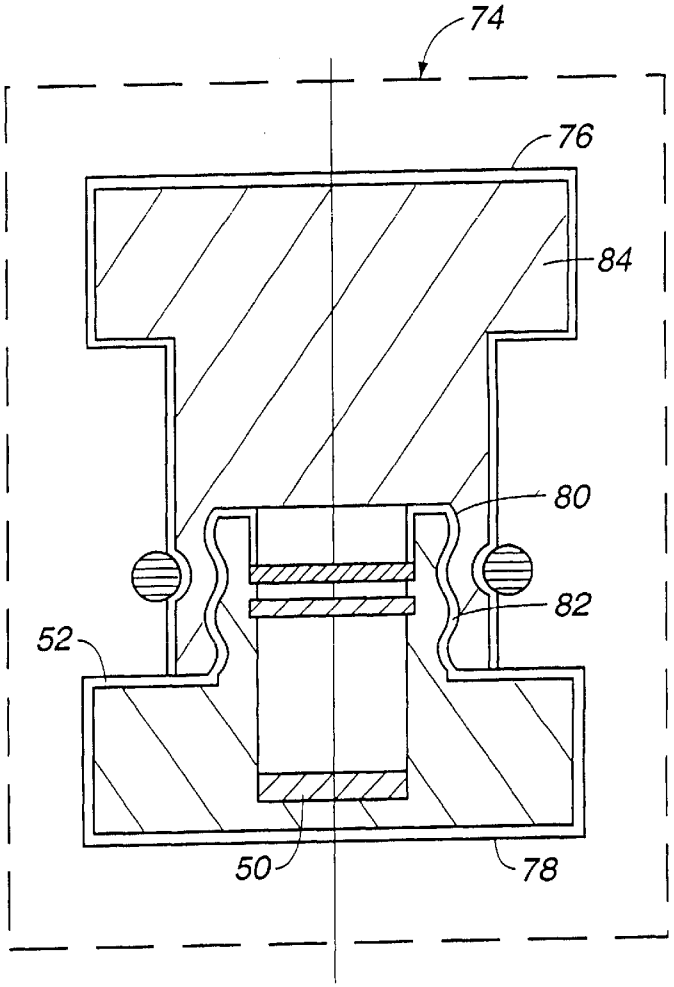
FIG. 5 shows a cross-sectional side view of a third embodiment of the invention.

FIG. 5 shows a cross-sectional side view of another embodiment of the present invention. Device 74 includes a first member 76 and a second member 78. Device 74 is similar to device 62, as can be seen by comparing FIG. 5 with FIG. 4. Unlike device 62, which includes body members 64 and 16 that are irreversibly attached during use, body members 76 and 78 includes threaded portions 80 and 82, respectively, that are threadably engaged during use. Body members 76 and 78 can be screwed together and then screwed apart without damaging body member 76. This way, the entire device can be reused. Friction is produced when body member 76 is engaged with or disengaged from body member 78. This friction generates triboluminescent light, which exposes film 50 if the polarizers are not crossed. Triboluminescent powders and other materials can be placed on the threaded surfaces to produce additional triboluminescent light. It is also possible to configure the threaded portions such that during the attachment process, minimal friction is generated but during the disengagement process, substantial friction is generated resulting in the production of considerable triboluminescent light.

An adhesive can be applied to the threaded portions of device 74 prior to attachment through a hasp. Since this effectively provides irreversible engagement between body members 76 and 78, removal from the hasp requires cutting away the wide portion 84 of body member 76 as previously described for device 10.

Figure 6:
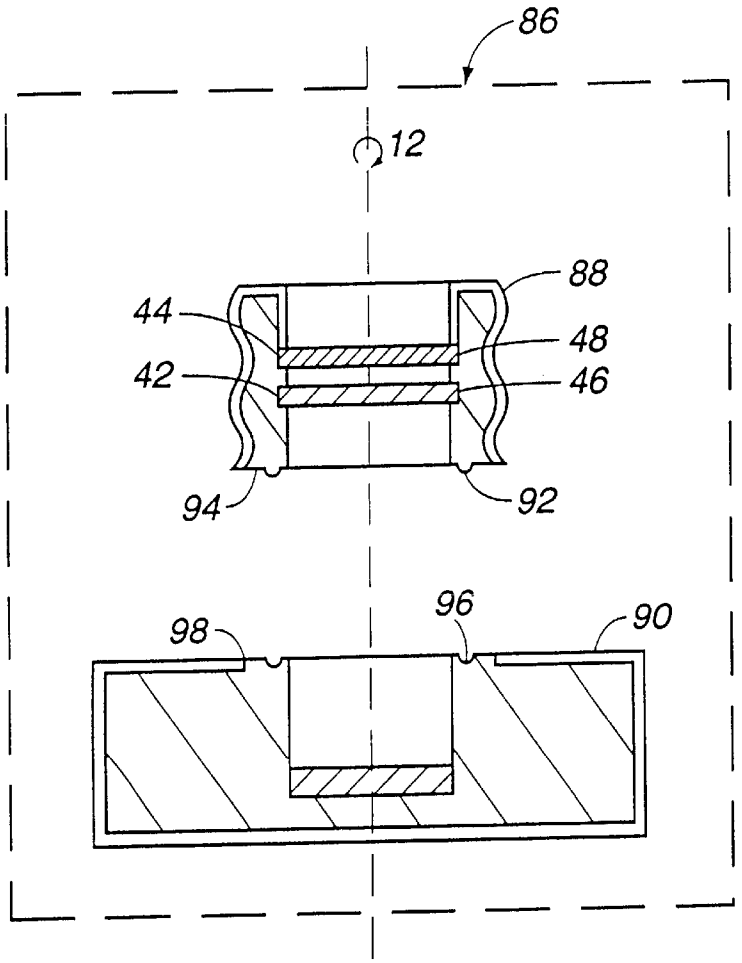
FIG. 6 shows a partially exploded, cross-sectional side view of a second body member of the invention.

Since body members 76 and 78 require that film 50 be inserted first prior to attachment of first polarizer 46, the relative orientation of the polarizers must be known for these embodiments before inserting the polarizers. This can be avoided if the body members were separated into attachable portions, a first portion that includes the polarizers and a second portion that includes the recess for the film. FIG. 6 shows a partially exploded side view of body member 86. Body member 86 includes first portion 88 and second portion 90. An annular protrusion 92 at end 94 of first portion 88 is configured to engage annular groove 96 at end 98 of second portion 90. An adhesive can be used to ensure that these portions are irreversibly, or at the very least very securely, engaged to produce body member 86. First portion 88 of body member 86 is assembled in ambient light. After first polarizer 46 is attached within groove 42, polarizer 48 is inserted into groove 44 in any orientation. While first portion 88 is viewed along axis 12, polarizer 48 is rotated until it is crossed with polarizer 46. This is not possible for body member 16, shown in FIG. 1, or for body member 78 shown in FIG. 5 since they must be assembled in the dark to avoid exposure of film 50. With the polarizers in portion 88 now crossed, portion 88 and portion 90 are taken into a darkroom, black bag, etc. and attached to form body member 86, which is, in all other respects, the equivalent of body member 78, shown in FIG. 5.

Figure 7:
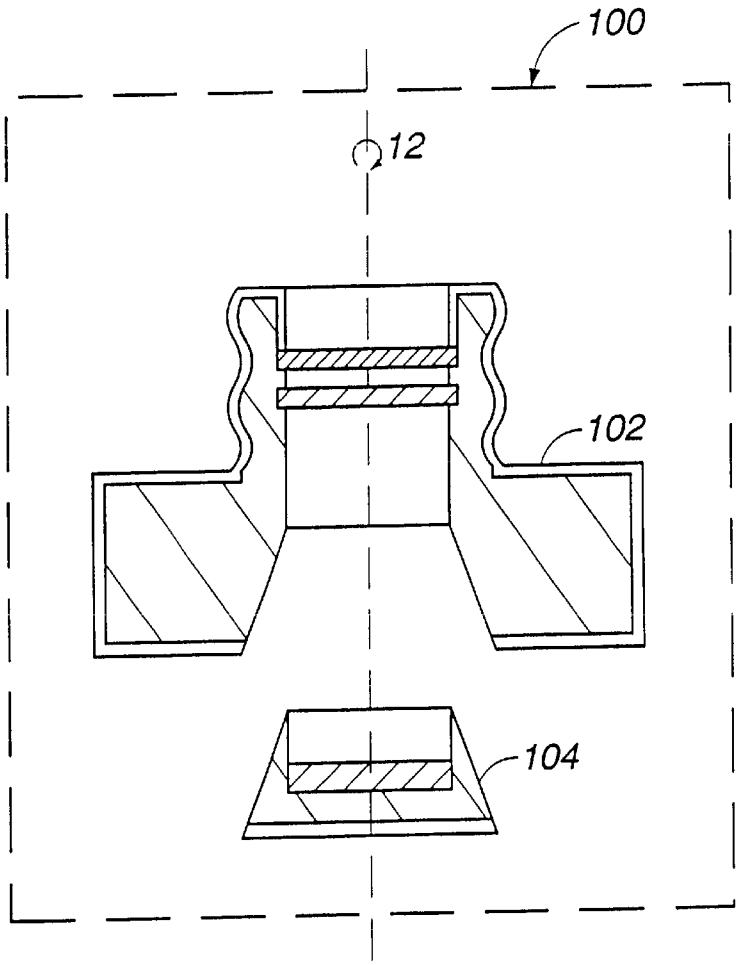
FIG. 7 shows a partially exploded, cross-sectional side view of a third body member of the invention.

FIG. 7 shows a cross-sectional side view of body member 100 having first portion 102 and second portion 104. Portion 102 has a conical-shaped recess for receiving conical shaped portion 104. An adhesive can be used to attach portion 102 to portion 104 to produce body member 100, which is in all other respects identical to body member 78 shown in FIG. 5.

Figure 8:
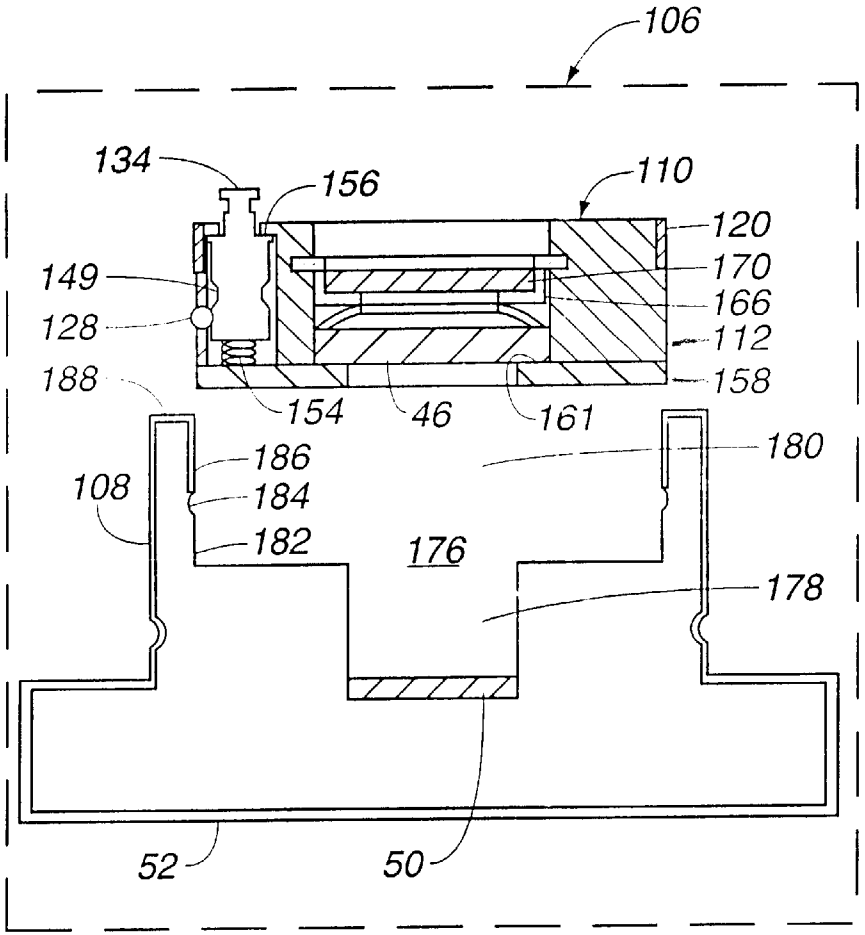
FIG. 8 shows a cross-sectional side view of a fourth body member of the invention that includes a cartridge and an attachable body portion.
Figure 9:
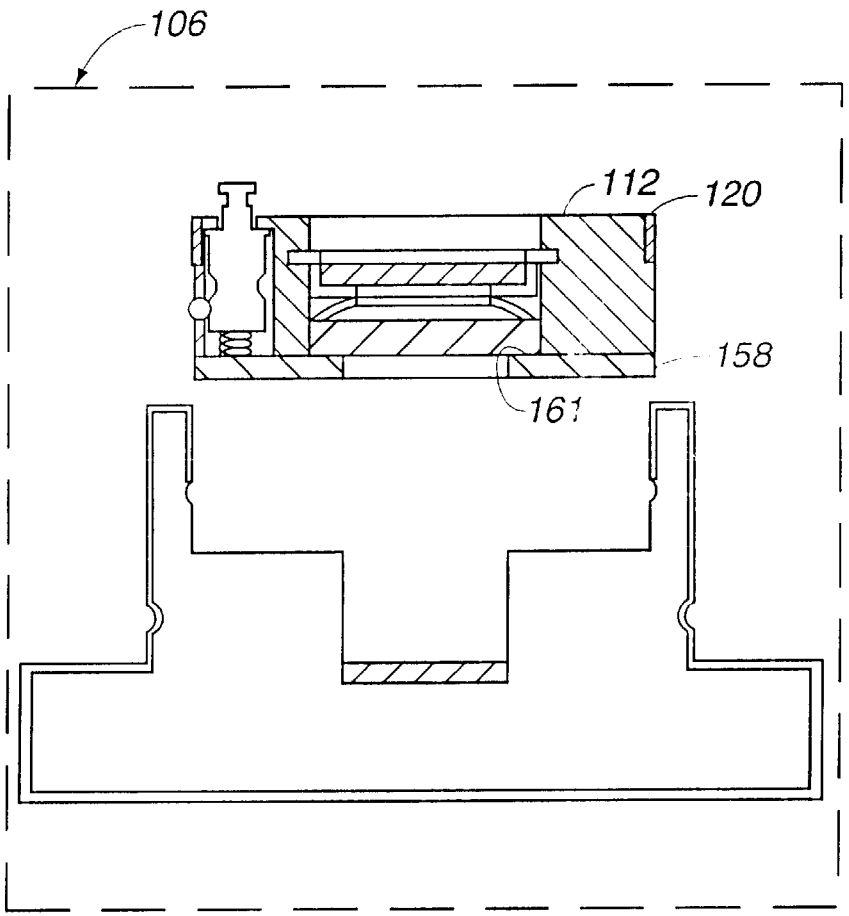
FIG. 9 shows a cross-sectional side view of the fourth body member of FIG. 8 after the cartridge is attached to the body portion.
Figure 10:
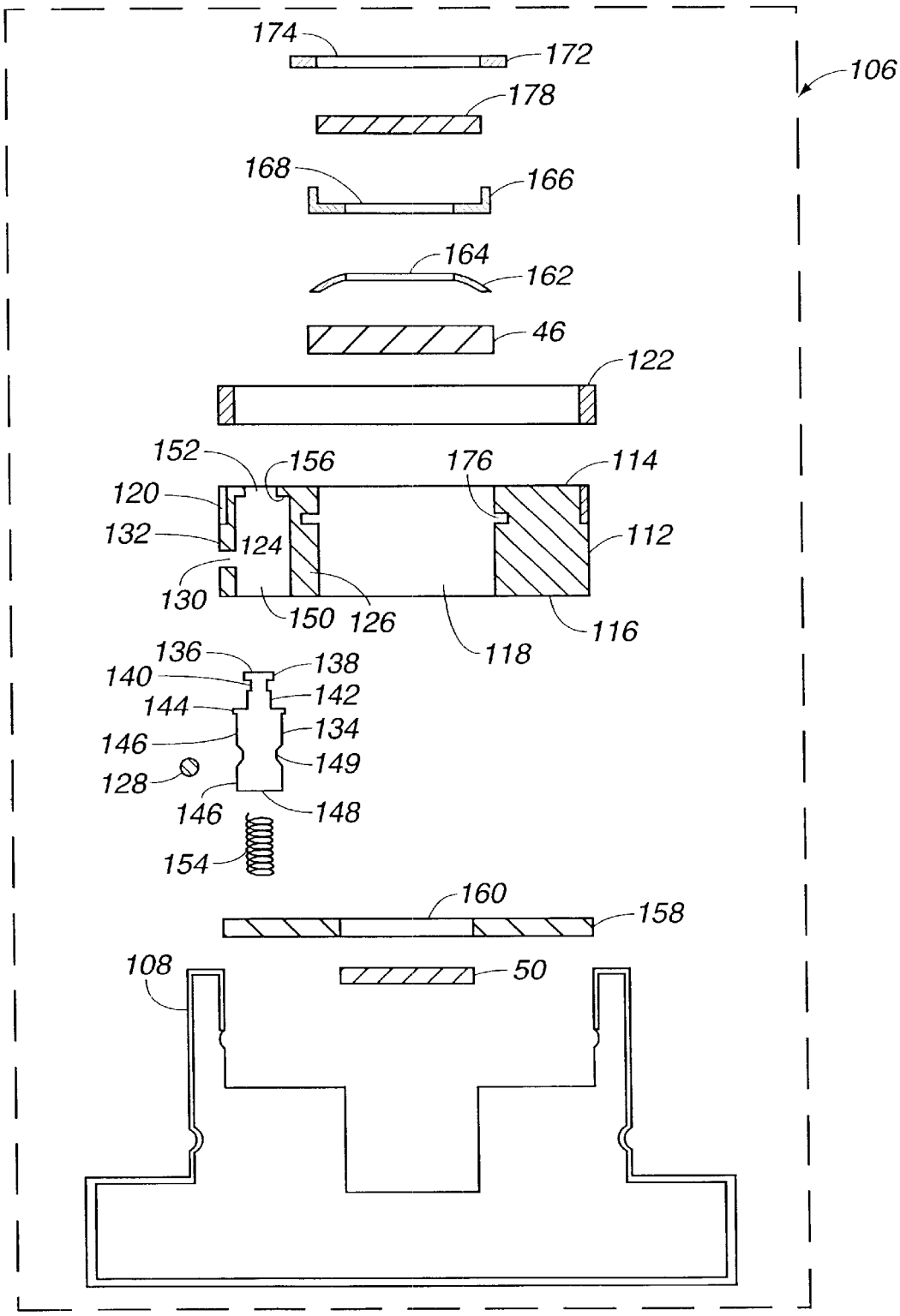
FIG. 10 shows an exploded cross-sectional side view of the fourth body member of FIG. 8.

FIG. 8 shows a partially assembled cross-sectional side view of body member 106. Body member 106, a preferred embodiment, includes body portion 108 and attachable cartridge 110, which includes fixed polarizer 46 and rotatable polarizer 170 that can be rotated in ambient light. FIG. 9 shows a cross-sectional side view of body member 106 after cartridge 110 is attached to body portion 108. FIG. 10 shows an exploded, cross-sectional side view of body member 106. Turning first to FIG. 10 and then back to FIG. 8 and FIG. 9, cartridge 110 includes cylindrical cartridge body 112 having a first end 114, a second end 116, and an axial passageway 118 therethrough. Outer circumferential recess 120 near first end is configured for receiving opaque flexible sealing ring 122. Cartridge body 112 also includes passageway 124 within cartridge wall 126. Passageway 124 is parallel to axial passageway 118. Ball 128 is placed within radial opening 130 that extends from passageway 124 through sidewall 132. A portion of ball 128 extends outside sidewall 132 when ball 128 fills radial opening 130. Cartridge 110 also includes rodlike locking pin 134. Locking pin 134 includes a first end 136 and, in sequence extending from first end 136, first end portion 138, narrower second portion 140, third portion 142 narrower than first portion but wider than second portion 140, flange 144 wider than the first portion, second end portion 146 narrower than flange 144, and second end 148. A hemispherical recess 149 is configured for receiving ball 128. Passageway 124 has a wide first portion 150 extending inward from second end 116 of cartridge body that is wide enough for locking pin 134 to pass through, and a narrower second portion 152 that is wide enough for first end portion 138 and third portion 142 to pass through but too narrow for flange 144 to pass through. Cartridge 110 also includes coil spring 154. Coil spring 154 may be attached to second end 148 of locking pin, or unattached as shown. After placing ball 128 into radial opening 130, first end 136 of locking pin 134 is inserted into passageway 124 until flange 144 contacts lip 156. If coil spring 154 is attached to locking pin 134, it is uncompressed and sticks out of passageway 124. If coil spring 154 is unattached as shown, it is positioned against second end 148 of locking pin 134, and cartridge end piece 158 is attached to second end 116 of cartridge 110. As FIG. 8 shows, end piece 158 compresses coil spring 154, which forces flange 144 of locking pin 134 against lip 156. End piece 158 has an axial passageway 160 that is narrower than axial passageway 118 of cartridge member 112. When end piece 158 is attached to second end 116 of cartridge member 112, a lip 161 as shown in FIG. 8 is produced that supports polarizer 46 after it is inserted through axial passageway 118. Polarizer 46 is attached to lip 161, preferably with an adhesive. Next, cupped washer 162 having an axial passageway 164 is inserted. Then polarizer holder 166 having axial passageway 168 is inserted. Holder 166 may include attached magnetic materials, and rests against cupped washer 162. Polarizer 170 is placed into holder 166. Retaining ring 172 having axial passageway 174 is placed within groove 176 of cartridge member 112. The combination of washer 162, holder 164, and retaining ring 172 hold polarizer 170 in place and prevent it from freely rotating. Polarizer 170 can now be rotated and crossed with fixed polarizer 46.

After the polarizers are crossed, cartridge 110 is taken into a darkroom, black bag, etc. for attachment to body portion 108. As FIG. 8 shows, body portion 108 includes a recess 176 having a narrow portion 178 into which film 50 is placed, and a wider portion 180 that is configured for receiving cartridge 110. Wider portion 180 is defined by cylindrical surface 182 having a cylindrical hemispherical recess 184 configured for receiving ball 128, and an opaque layer 186 extending from hemispherical recess 184 to end 188. To insert cartridge 110, locking pin 134 is depressed until ball 128 lines up with recess 149 in the locking pin 134.

Cartridge 110 is then inserted into wide portion 180 of recess 176 of body portion 108. As the cartridge enters, ball 128 is forced into hemispherical recess 149 of the locking pin 134. When cartridge 110 is completely inserted, ball 128 and hemispherical recess 184 of body portion 108 are in alignment. When the locking pin is released, spring 154 forces locking pin against lip 156, and ball 128 is forced out of locking pin recess 149, through radial opening 130, and into hemispherical recess 149. Cartridge 110 is now attached to body portion 108. Opaque sealing ring 122 seals against opaque portion 186 to prevent ambient light from leaking in. The body member 106 is now ready for use as previously described for devices 10 and 62. A body member similar to body member 14, shown in FIG. 1, may be used to complete the device of the present invention if recess 30 of body member 14 could accommodate the portion of locking pin 134 that extends into the recess.

Various ways a body member can be separated into portions so that a rotatable polarizer can be crossed with fixed polarizer in ambient light have been described. Clearly, there are other ways to separate the body member into portions for this purpose that would provide a body member whose function would not depart from the general principles of the invention.

Figure 11:
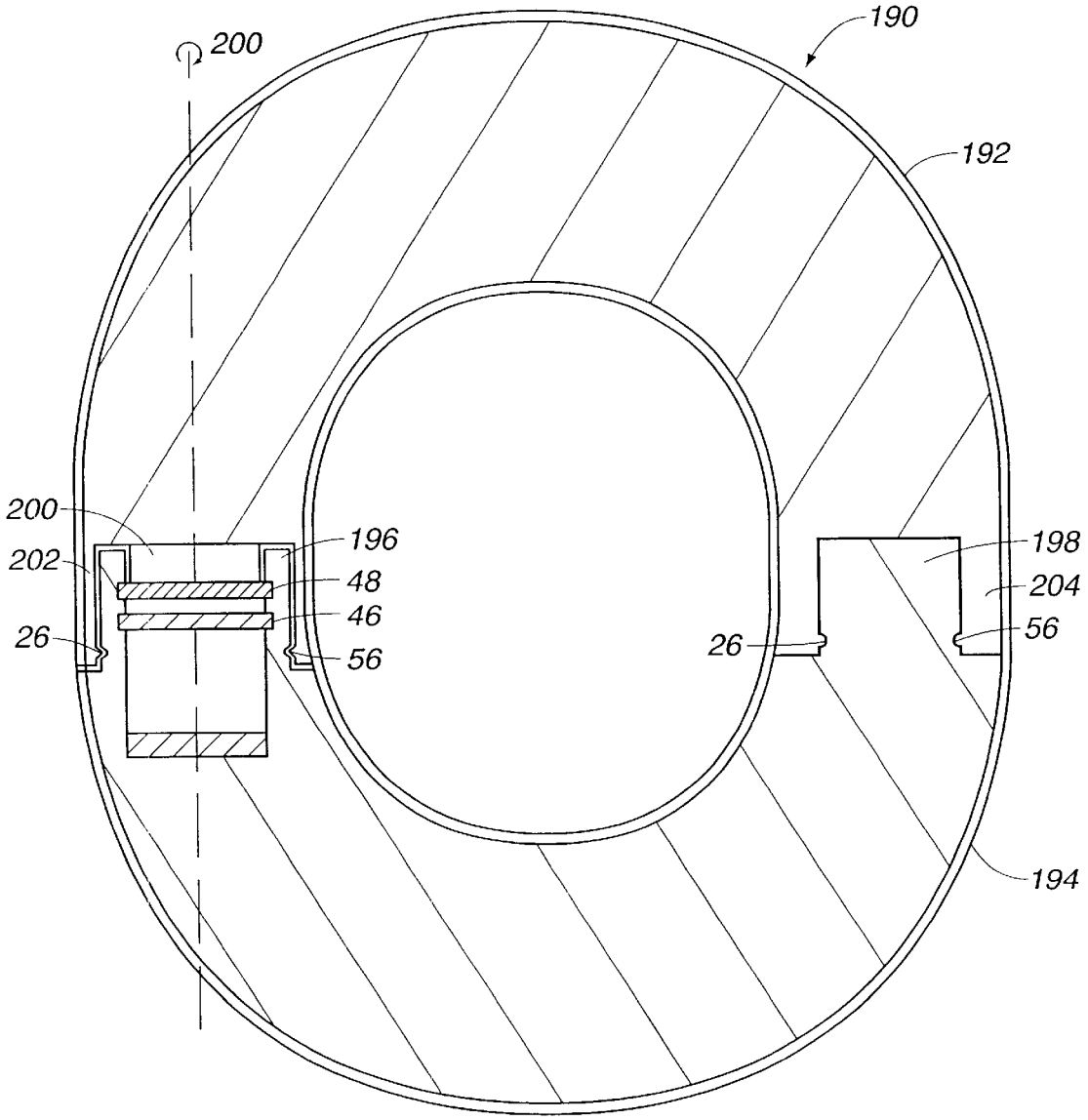
FIG. 11 shows a cross-sectional side view of an embodiment of the invention having a torus-like body.

The embodiments of the device described thus far have a shape that allows them to be used with a hasp; they have a middle portion that is narrow enough to fit through a hasp and two wider end portions that cannot. Clearly, other body shapes can also be used that, once attached to a hasp, cannot be removed without damage. For example, FIG. 11 shows a perspective view of device 190, which has a torus-like shape after attachment through a hasp. Device 190 includes a first body member 192 and an attachable second body member 194. Second body member 194 has a first end portion 196 and a second end portion 198. First end portion 196 includes an axial recess 200 into which fixed polarizer 46, rotatable polarizer 48, and film 50 are stored as previously described for device 10 shown in FIG. 2. First body member 192 has a first end portion 202 and a second end portion 204. First end portion 202 of first body member 192 includes a surface configured for attachment with first end portion 196 of second body member 194. Second end portion 198 is also configured for attachment with second end portion 204 such that rotation about axis 200 is impossible. It should be understood that device 190 could be suitably modified to include cartridge 110, shown in FIG. 8. Similarly, other embodiments such as device 62 shown in FIG. 4 can also incorporate 110 shown in FIG. 8 and in FIG. 9.

Many triboluminescent materials, which include organic and inorganic compounds and mixtures, can be used with the present invention. Some of these include sphalerite, cholesteryl salicylate, N-isopropylcarbazole, and carborundum. Other triboluminescent materials are described in U.S. Pat. No. 5,905,260 to I. C. Sage et al. entitled "Triboluminescent Damage Sensors", which issued May 18, 1999 and incorporated by reference.

The light-transmitting portions of device 10 may include a single triboluminescent material, a mixture of triboluminescent materials, or a mixture of triboluminescent and non-triboluminescent materials. Mixtures include a non-triboluminescent matrix material embedded with triboluminescent material. Matrix materials include glass, polymers, and other transparent and/or translucent materials. For example, a substantially stressed tempered glass matrix embedded with triboluminescent material provides an extremely strong device that would disintegrate dramatically if cut, drilled, sawed, or exposed to high temperatures.

It would be extremely difficult to determine the rotational orientation of polarizers 46 and 48 without physically penetrating the device of the present invention. Interrogation using x-rays would be difficult and would likely fog film 50.

Any combination of optical elements where the angular orientation of one or more of the optical elements can be adjusted such that light either passes or does not pass through the assembly can be used in place of linear polarizers. These optical elements may include, in various combinations, circular polarizers, retardation plates, liquid crystal filters, colored filters, dichroic or interference filters, etc. Obviously, optical assemblies of optical elements that permit light to pass or not to pass based on some adjustment other than rotational angle could also be used.

Film 50 could be protected from exposure while it is being inserted or removed from the device. If, for example, bandpass color filters, high-pass color filters, low-pass color filters, or circular polarizers were placed in direct contact with the undeveloped film 50, removal of film 50 would not require a darkroom, black bag, etc. Instead, the film could be recovered in the presence of light having a range of wavelengths or having a particular handedness.

Ring magnet 72 may be a single piece rare earth magnet or a combination of magnetic and non-magnetic materials having a bulk magnetization either perpendicular to the ring plane, or preferably in the ring plane. For example, ring magnet 72 may be a substantially plastic ring with one or more rare earth magnets attached. If a magnet or material attracted to magnets, such as iron or steel, is attached to polarizer 48, then ring magnet 72 will exert a force on the polarizer. Polarizer 48 could also be attached to a magnetic holder that would be forced to rotate using ring magnet 72. The embodiments using magnets are examples of using a non-contact means for polarizer rotation. Other embodiments in the spirit of the invention might also include a contact means for rotating the polarizer, such as wheels and polarizers having spokes that are in contact.

As FIGS. 1, 2, and 4 show, surface protrusion 26 is shown as an extension of body member 14. The combination of protrusion 26 and recess 56 provide an irreversible mechanical assembly. Without departing from the spirit of the invention, clearly there are other obvious ways that can be imagined to reversibly attach the body members, and to irreversibly attach them so that attempts at disengagement result in friction, or damage, that produces triboluminescent light. Surface protrusion 26, for example, can be replaced with a cylindrical groove, and then a locking ring can be inserted into the groove such that a portion of the locking ring protrudes from the groove. The locking ring, of course, would irreversibly engage recess 56.

The device requires that a reference image be stored for later comparison to the identical image recorded on the film used with the invention. The comparison image could be stored on film. It could also be stored digitally in a computer or digital camera. The image should be a secret image, and could be a real world scene, a computer generated graphic, etc. Film 50 can be photographic film, or any image storing means bearing a stored image that would be at least damaged when exposed to ambient and/or triboluminescent light. Other types of light such as infrared, ultraviolet, x-rays, etc. could also damage or erase the image.

The present invention may also include other features to complicate an attack upon it. For example, the invention may include additional chambers, polarizers, pieces of film, etc. The device may include reflective microparticles mixed into the light transmitting body members in order to enhance internal reflection of tribouminescent generated light. If reflective microparticles are used, a micrograph of the device made prior to applying the opaque coating would provide the locations of these particles for identification purposes, which would make replacement with a counterfeit even more difficult.

The invention may include a reflective layer adjacent to and covered by the outer opaque layer in order to reflect triboluminescent-generated light back through the light transmitting portions of the device.

The invention may include chemiluminescent materials that generate additional light if attacked with solvents or acids. For example, a mixture of luminol, sucrose, perborate, and copper sulfate will chemiluminesce in the presence of water, various solvents, or an oxidizer.

The present invention could be configured such that the internal chamber used to store film could also store documents, and other objects that require protection against tampering or unauthorized access. In fact, the undeveloped image on the film, when developed, could be the stored document.

Thus, the tamper-indicating device of the present invention provides permanent and non-erasable evidence of unauthorized access to a building, container, etc. The device is extremely difficult to counterfeit since each one can be provided with a secret, unique image that would be damaged or destroyed in the act of gaining unauthorized access to it.

The above examples of the present invention have been presented for purposes of illustration and description and are not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A tamper-indicating device for storing objects, comprising;

(a) a transparent or translucent body comprising triboluminescent material;

(b) image-storing means, said image storing means comprising an undeveloped image that will sustain damage when exposed to ambient light;

(c) a chamber within said body for storing said image-storing means and objects;

(d) means for preventing the exposure of said image to ambient light.

2. The device of claim 1, wherein said transparent or translucent body comprises glasses, polymers, and mixtures of glasses and polymers.

3. The device of claim 1, wherein said image-storing means comprises photographic film.

4. The device of claim 1, wherein said means for preventing comprises an outer opaque layer coating said body.

5. The device of claim 1, wherein said transparent or translucent body comprises a cylindrical body having an axis and a first end portion, a second end portion, and a middle portion, the middle portion being narrower than either said first end portion or said second end portion.

6. The device of claim 5, wherein said middle portion is narrow enough to fit through a hasp and both first end portion and second end portion are too wide to fit through the hasp.

7. The device of claim 1, wherein said body comprises a torus or torus-like shaped body.

8. A tamper-indicating device, comprising:

(a) a transparent or translucent body comprising at least one triboluminescent material, said body having an internal chamber;

(b) image-storing means inside the chamber, said imaging means bearing an undeveloped image that can be damaged or destroyed by light;

(c) optical assembly means, at least a portion of which comprises a wall of said chamber, said optical assembly means adjustable to permit or prevent light from passing through the assembly and entering the chamber;

(d) an opaque barrier layer attached to said body, said barrier layer preventing ambient light from entering said body from the outside but not preventing transmission of light through said body that is generated in the body from said triboluminescent material.

9. The device of claim 8, wherein said transparent or translucent body comprises a material selected from the group consisting of glasses and polymers.

10. The device of claim 8, wherein said optical assembly means comprises light polarizers.

11. The device of claim 8, wherein said optical assembly means further comprises a fixed light polarizer, a rotatable light polarizer, and an external ring magnet slidably engaged to said transparent or translucent body, said ring magnet causing said rotatable polarizer to rotate when said ring magnet rotates.

12. The device of claim 8, wherein said optical assembly further comprises circular polarizers, retardation plates, liquid crystal filters, color filters, dichroic or interference filters, or combinations thereof.

13. The device of claim 8, wherein said transparent or translucent body comprises a first cylindrical member and an attachable second cylindrical member, said first member having a wide end portion and a narrow end portion with a cylindrical recess defined by a cylindrical surface having a cylindrical protrusion, said second member having a wide end portion and a narrow end portion having a cylindrical recess defined by a cylindrical inner surface having an cylindrical groove configured for engagement with said cylindrical protrusion of said first member.

14. The device of claim 13, further including grooves along the cylindrical surface defining the recess within said second member for engaging said fixed polarizer and said rotatable polarizer.

15. The device of claim 13, wherein said image-storing means comprises photographic film.

16. A tamper-indicating device, comprising:

(a) a transparent or translucent cylindrical body comprising at least one triboluminescent material, said body having an axis and a first end portion, a second end portion, and a middle portion having a diameter narrower than the diameter of either said first end portion or said second end portion, said body further comprising an internal chamber having walls;

(b) image-storing means sensitive to light inside said chamber and bearing an undeveloped image;

(c) a fixed polarizer comprising a wall of said chamber;

(d) a rotatable polarizer near and coaxial with said fixed polarizer;

(e) means for rotating said rotatable polarizer in order to control the passage of light through the combination of said fixed polarizer and said rotatable polarizer; and (f) an opaque barrier layer attached to said body, said barrier layer preventing ambient light from entering said body from the outside but not preventing transmission of light through said body that is generated in the body from said triboluminescent material.

17. The device of claim 16, wherein said transparent or translucent body comprises glasses, polymers, and mixtures thereof.

18. The device of claim 16, wherein said means for rotating said rotatable light component comprises a slidable ring magnet coaxial with and rotatably engaged to said transparent or translucent body, said ring magnet causing said rotatable polarizer to rotate when said ring magnet rotates.

19. The device of claim 18, wherein said fixed polarizer and said rotatably polarizer comprise linear polarizers, circular polarizers, retardation plates, liquid crystal filters, colored filters, and dichroic filters.

20. The device of claim 16, wherein said transparent or translucent cylindrical body comprises a cylindrical first body member and a cylindrical second body member, said first body member comprising a wide first end portion and a narrower second end portion having a cylindrical recess defined by an inner surface having a cylindrical protrusion, said second body member having a wide first end portion and a narrow second end portion having a cylindrical recess defined by a cylindrical surface that includes a groove for engaging the protrusion of said first member.

21. The device of claim 20, wherein the cylindrical inner surface of said second member includes grooves for engaging said fixed polarizer and said rotatable polarizer.

22. The device of claim 16, wherein said transparent or translucent body comprises a cylindrical first member and a cylindrical second member, said first member having a wide end portion and a narrow end portion having a recess defined by a cylindrical, threaded inner surface, said second member having a wide end portion and a cylindrical narrow end portion having a cylindrical recess and a threaded outer surface portion configured for engagement with said threaded inner surface of said first member.

23. The device of claim 16, wherein said image-storing means comprises photographic film.

* * * * *